United States Patent [19]

Sollinger et al.

[11] Patent Number: 4,908,958

[45] Date of Patent: Mar. 20, 1990

[54] DRIVE OF A FELT GUIDE ROLL

[75] Inventors: Hans-Peter Sollinger, Heidenheim; Rudolf Beisswanger, Steinheim, Fed. Rep. of Germany

[73] Assignee: J.M. Voith GmbH, Heidenheim, Fed. Rep. of Germany

[21] Appl. No.: 255,167

[22] PCT Filed: Jan. 12, 1988

[86] PCT No.: PCT/EP88/00018

§ 371 Date: Oct. 5, 1988

§ 102(e) Date: Oct. 5, 1988

[87] PCT Pub. No.: WO88/05478

PCT Pub. Date: Jul. 28, 1988

[30] Foreign Application Priority Data

Jan. 22, 1987 [DE] Fed. Rep. of Germany ... 8700994[U]

[51] Int. Cl.[4] ..... F26B 11/02

[52] U.S. Cl. ..... 34/121; 34/123; 34/116

[58] Field of Search ..... 34/121, 113, 116, 117, 34/94, 157; 68/5 D

[56] References Cited

U.S. PATENT DOCUMENTS 4,181,039 1/1980 Phelps ..... 34/121 X 4,495,712 1/1985 Justus ..... 34/121 X

*Primary Examiner*—Henry A. Bennet

*Assistant Examiner*—John Sollecito

*Attorney, Agent, or Firm*—Ostrolenk, Faber, Gerb & Soffen

[57] ABSTRACT

A drive for the guide roll of a drying felt or wire in the drying group of a paper machine, or the like. A gear transmission drives a selected one of the paper web guide rolls, which may be a drying cylinder, in a first group of rolls. The felt or wire is wrapped around a second group of rolls comprising felt or wire guide rolls. The one felt or wire guide roll located nearest the gear transmission is connected to the shaft of a drive gear of the gear transmission via a belt drive connection. Thus, rotation of the drive gear of the gear transmission via the gear transmission drives the one selected driven roll of the first group, and via the belt drive connection drives the driven felt or wire guide roll.

10 Claims, 1 Drawing Sheet

DRIVE OF A FELT GUIDE ROLL

BACKGROUND OF THE INVENTION

The present invention relates to a drive of a felt guide roll in a drier group of a paper machine.

In a drier group a higher web tension frequently is present at its end than in the preceding paper sections where the web of paper is even wetter. A felt or wire (which will both be referred to herein generically as a "felt"), in addition, generally wraps around the paper guide rolls of the drier group together with the web of paper in order to dry and guide the latter. In order for this guide function to remain assured and for the felt not to brake the web of paper and eliminate the adherence to the paper guide rolls, it is necessary to assure speeds of felt and paper web which are as identical as possible.

SUMMARY OF THE INVENTION

It is therefore advisable to drive the felt or wire, in particular, by a felt or wire guide roll. It is possible here to provide separate electric motors for such a drive. However, this is very expensive and it is difficult to assure precise synchronism of felt and paper web.

This objective is achieved in accordance with the invention by a drive for a guide roll of a felt or wire used in the drying group of a paper machine, or the like. To drive the web, a gear transmission drives a selected one of the paper web guide rolls, which may be a drying cylinder, in a first group of drying rolls. The felt or wire is wrapped around a second group of rolls comprising felt or wire guide rolls. The arrangement may be such that the felt or wire is above the array of drying rolls.

One selected guide roll of the second group, which is the driven roll, is connected with the shaft of a drive gear of the gear transmission via a belt drive transmission. Preferably, the felt or wire guide roll that is connected with the belt transmission is one of the felt or wire guide rolls that is near to the driving gear of the gear transmission, and it preferably is the closest one to that gear. Rotation of the drive gear causes the gear transmission itself to drive the selected one roll of the first group; while via the belt transmission it drives the driven guide roll of the second group.

The drive gear of the gear transmission includes a drive pinion which is on a shaft to which the drive pulley of the belt transmission is attached.

The driven felt or wire guide roll supports the felt. At the end of that driven guide roll is a shaft that carries a driven belt pulley. The belt pulley on the driven shaft is disposed between the end of the driven felt or wire guide roll and a bearing in which that shaft of the driven guide roll is supported.

It has been found that excellent synchronism can be obtained with this solution even when the web is accelerated.

BRIEF DESCRIPTION OF THE DRAWINGS

One embodiment of the invention is shown in the drawings, in which.

DESCRIPTION OF A PREFERRED EMBODIMENT

Figure 1:
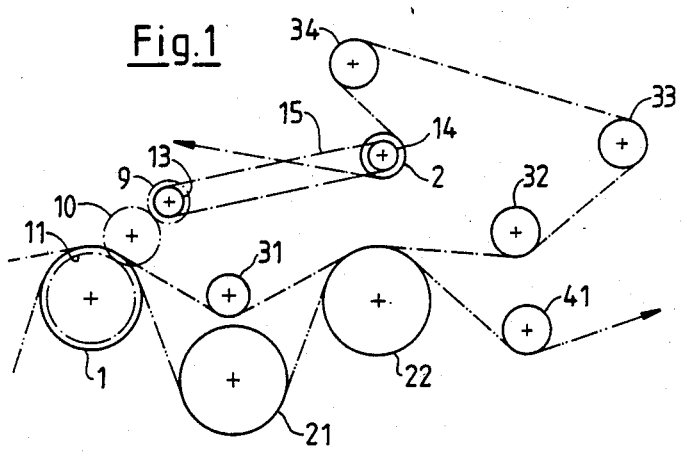
FIG. 1 is a simplified diagram showing the guidance of the web and felt.

FIG. 1 shows diagrammatically an end view of the drier group. The paper web, indicated by dash-double-dot lines, is guided around the web guide rolls 1, 21, 22 and 41. The guide roll 1 is driven by gears 9, 10 and 11 —shown schematically by circles in dash-dot lines —of a transmission gearing 6. The felt guide rolls are designated 2, 31, 32, 33 and 34. The felt is indicated in dash-dot lines. The felt guide roll 2 for the upper course of the felt, which roll is closest to the gearing 6 or to the paper guide roll 1 driven by the gearing, which paper guide roll 1 may also be a drying roll, is driven via belt pulleys 13 and 14 and belt 15 by the shaft 12 of the drive pinion 9 of the transmission gearing 6, as can be noted in further detail from FIG. 2.

Of course, a felt guide roll for a lower course of felt (not shown) and driven by the shaft of another gear wheel also could be considered for the drive.

Figure 2:
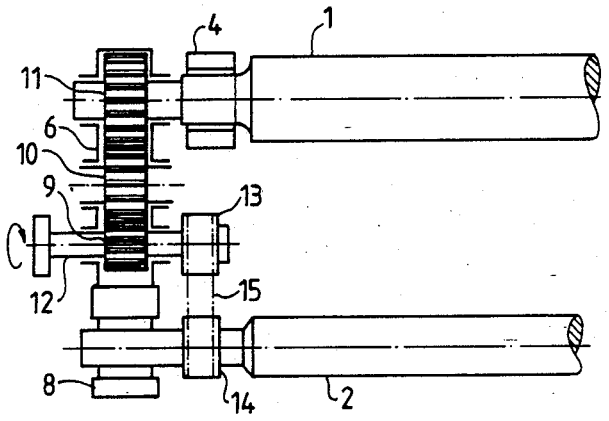
FIG. 2 is a top view, partly in section, of the region where the gears, the driven paper guide roll, and the driven felt guide roll are located.

In FIG. 2 the belt pulley 14 of the felt guide roll 2 is shown as being arranged between the roll 2 and its bearing 8. The left-hand bearing 4 of the driven paper guide roll 1 is also indicated here.

The belt can be either smooth, that is, flat, or can be developed as a multiple-V belt.

The type of drive described is of very simple construction, operates very accurately, and is therefore fully satisfactory.

We claim:

1. A drive of a guide roll for an endless felt or wire of a drying group, wherein the drying group comprises:

a first group of rolls over which a web to be dried is passed;

a second group of rolls comprising felt guide rolls over which a felt or wire disposed for being contacted against the web is passed, the guide rolls being placed so as to cause a felt or wire passing over the guide rolls to contact at least some of the first group of rolls with the web sandwiched between those contacted rolls and the guided felt or wire;

a gear transmission including a plurality of gears, with a first one of the gears being at a selected one of said first group of rolls for driving it to rotate and a second of the gears being connected to the first gear so that said first and second gears rotate synchronously;

a selected one of the guide rolls of the second group having belt-drivable means thereon; the second gear of the transmission having a belt driving means thereon; a belt connection being provided between the belt drivable means on the selected guide roll and the belt driving means on the second gear; such that rotation of the second gear drives the selected roll of said first group to rotate via the gear transmission, and drives the selected guide roll of the second group to rotate via the belt connection.

2. The drive of claim 1, wherein the guide rolls include an array of the guide rolls for directing a felt around a pathway that includes a pass over some of the first rolls; some of the guide rolls being nearer to the one selected roll of said first group than are the other guide rolls, and the guide roll which is connected by the belt connection with the second gear being one of the guide rolls near to the selected roll of the first group.

3. The drive of claim 1, wherein the guide roll driven by the belt transmission is the guide roll that is nearest to the second gear.

4. The drive of claim 2, wherein the guide rolls and a felt supported thereby are generally disposed above the first group of rolls and the driven guide roll is disposed above the second gear.

5. The drive of claim 1, wherein the guide rolls and a felt supported thereby are generally disposed above the first group of rolls and the driven guide roll is disposed above the second gear.

6. The drive of claim 1, wherein the belt driving means comprises the second gear including a shaft connectable for being rotated; and a drive belt receiving pulley carried on the shaft; and the belt connection comprises a drive belt received on the pulley.

7. The drive of claim 6, wherein the belt drivable means comprises a drivable belt pulley supported on the driven selected guide roll and the drive belt from the drive belt receiving pulley on the second gear is received on the drivable belt pulley on the driven selected guide roll.

8. The drive of claim 7, wherein the driven selected guide roll has an end at which the drivable belt pulley is disposed, and a bearing for supporting the drivable belt pulley, and the bearing is located outward of the driven selected guide roll and outward of the drivable belt pulley, so that the drivable belt pulley is between the selected guide roll and the bearing therefor.

9. The drive of claim 1, wherein at least one of the first group of rolls is a drying cylinder.

10. The drive of claim 1, further comprising a felt guided over the second group of guide rolls.

* * * * *